US006053069A

United States Patent [19]

Stroer

[11] Patent Number: 6,053,069

[45] Date of Patent: Apr. 25, 2000

[54] TWO PIECE HAND BRAKE RELEASE HANDLE

[75] Inventor: W. Kurt Stroer, Frankfort, Ill.

[73] Assignee: Westinghouse Air Brake Company, Wilmerding, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 09/061,313

[22] Filed: Apr. 16, 1998

[51] Int. Cl.[7] ..... G05G 1/04

[52] U.S. Cl. ..... 74/523; 74/546; 74/547

[58] Field of Search ..... 74/523, 524, 525, 74/544, 546, 547

[56] References Cited

U.S. PATENT DOCUMENTS

| | | | |
|---|---|---|---|
| 1,300,384 | 4/1919 | Hanahan | 74/547 |
| 3,119,278 | 1/1964 | Simpson | 74/544 X |
| 3,544,069 | 12/1970 | Grego | 74/524 |
| 4,297,916 | 11/1981 | Burroughs | 74/544 |
| 5,524,505 | 6/1996 | Lawrence | 74/544 |

FOREIGN PATENT DOCUMENTS

| | | | |
|---|---|---|---|
| 476208 | 3/1992 | European Pat. Off. | 74/547 |

*Primary Examiner*—Mary Ann Battista
*Attorney, Agent, or Firm*—James Ray & Associates

[57] ABSTRACT

A two piece hand brake release handle for a railway car hand brake mechanism having a relatively long lever one end of which is rotably fitted onto a rotatable brake release post extending from the hand brake mechanism, such that manual rotation thereof will not cause rotation of the brake release post, and a relatively short lever arm tightly fitted onto the brake release post such that rotation thereof will cause rotation of the brake release post, with the relatively short lever arm having an arm engaging flange extending transversely to receive and engage the relatively long lever arm such that manual rotation of the long lever arm in a given rotational direction will cause the long lever arm to engage the flange so that continued rotational movement of the long lever arm in the same rotational direction will cause rotational movement of the short lever arm, and accordingly, rotational movement of the brake release post as necessary to effect a brake release.

27 Claims, 4 Drawing Sheets

TWO PIECE HAND BRAKE RELEASE HANDLE

CROSS-REFERENCE TO RELATED APPLICATION

This application is related to application Ser. No. 09/061,314 filed on even date herewith, entitled "JOINTED HAND BRAKE RELEASE HANDLE", which is assigned to the assignee of the present application, and is incorporated herein by reference.

FIELD OF THE INVENTION

The present invention relates generally to hand braking apparatus for railway cars and, more particularly, this invention relates to a new, unique and improved hand brake release handle for use with any conventional hand brake mechanism as is normally mounted on a railway car for applying and releasing the hand brake system of the railway car. The new and unique hand brake release handle of this invention is designed so that an essential, elongated portion thereof will hang freely downward from the hand brake mechanism when not in use to thereby prevent it from remaining in a fixed position that may leave it in harms way to unintentionally present a nuisance or hazard to railway personnel and others who could be injured by such a handle extending outwardly.

BACKGROUND OF THE INVENTION

As is generally well known in the railway industry, when railway cars are taken out of a train and parked at a siding or yard, the hand brakes on at least some of these cars are applied as a precaution against unwanted or unexpected movement of the cars. A typical railway car hand brake system normally consists of an apparatus for manually applying and biasing one or more brake shoes against one or more wheels of the railway car by either turning a hand wheel or pumping a ratchet handle on a hand brake mechanism attached to the railway car. The hand brake mechanism is usually either a cast or stamped metal gear housing usually attached to an outside end wall of the railway car and having a rotatable chain drum therein which can be rotated by turning the hand wheel or pumping the ratchet handle on the hand brake mechanism to wind a brake chain onto the chain drum. The other end of the brake chain normally extends through the bottom of the gear housing and is interconnected with cables or other linkage to brake shoes, such that winding of the brake chain onto the chain drum will apply tension to the brake chain and linkage as necessary to draw the interconnected brake shoes against adjacent railway car wheels and accordingly, apply the hand brake as intended. In view of the fact that the hand brake, when applied, will put the brake chain and linkage in considerable tension, the hand brake mechanism must also include a lock means for locking the chain drum in place when the hand brake has been applied, to thereby maintain the tension in the brake chain and linkage and, accordingly, maintain the hand brake in the applied condition. Such a locking means normally comprises a ratchet wheel and pawl system within the hand brake mechanism to maintain the rotational position of the chain drum. A significant number of different hand brake mechanisms are generally well known in the railway industry, an example of which is disclosed in U.S. Pat. No. 5,127,283, assigned to the assignee of this invention. and is incorporated herein by reference.

Although turning the hand wheel in the opposite direction may operate to release the hand brake in proportion to the extent of such turning, some ratchet wheel and pawl systems may not permit turning the hand wheel in the opposite direction. Accordingly, most hand brake mechanisms are provided with a quick release, non-spin mechanism which functions to instantly and completely release the hand brake without causing the hand wheel or ratchet handle to spin as the lock means on the chain drum is released. Such quick release mechanisms usually function by completely disengaging the chain drum from the lock means and gear mechanism for turning the chain drum. The quick release mechanism is normally activated by pivoting a hand brake release handle, the hand brake release handle being attached to a brake release shaft, which when rotated by the hand brake release handle outside of the gear housing, will disengage the chain drum from the mechanism locking it in place, thereby permitting the chain to self unwind from the chain drum. Normally, the outer end of the brake release shaft is provided with a tight-fitting lever arm type of hand brake release handle so that to release the hand brake, the handle or lever arm is merely pushed upwardly to rotate the brake release shaft (normally clockwise) as necessary to completely release the hand brake.

After the hand brake is released, and the hand brake release handle is released from manual manipulation, ideally, the hand brake release handle should return to its starting position by the force of gravity. However, due to frictional forces within the hand brake mechanism, the hand brake release handle may not return to a start position by the mere force of gravity, but often times will remain extending outwardly from the hand brake mechanism where it was when the brakeman released his grip thereon. If the brake release handle is left in that position, extending outwardly from the hand brake mechanism, it can become a nuisance, or worse yet, a serious hazard. In extending outwardly from the hand brake mechanism, it may in some situations extend into the path of the ladder at the end of the railway car, or even extend beyond the edge of the railway car into the path of persons adjacent to the railway car, and thus present a hazard not only to railway personnel but also to pedestrians who may be standing or walking adjacent to such a railway car. Indeed, such a rigid lever arm extending laterally beyond the edge of the railway car would not only be hazardous to personnel, but if the car is in motion, the hazard would be greatly increased, and could even seriously damage railroad structures immediately adjacent to the track upon which such a railroad car is moving, not to mention damage which would result to the railway car itself and the hand brake mechanism attached thereto should such an extending handle strike a fixed object. Reference to FIG. 2 will illustrate one example of a prior art hand brake mechanism whereby the hand brake release handle does extend outwardly as described above.

While the hazard could be eliminated by manually forcing the hand brake release handle back to its starting position after it is utilized to effect a brake release, this often is not done by busy railway personnel, thus being inadvertently left in a position as illustrated in FIG. 2, creating the above said nuisance and/or hazard. Accordingly, what is needed is a hand brake release handle which cannot remain disposed in such a nuisance or hazardous position, but rather will return automatically to its starting position without relying on railway personnel. While the hazard would automatically be eliminated by making the brake release handle or lever arm significantly shorter so that it cannot extend outwardly by a sufficient length to be a nuisance or hazard, this would obviously also increase the moment force or torque required to effect a brake release, and could even make it impossible to effect a brake release without superhuman strength. It has also been realized that some sort of a ratcheting system could be developed for the hand brake release handle or release mechanism to eliminate the above-noted nuisance and hazards, but obviously such a ratcheting system would even further complicate the already complicated hand brake mechanism, which already includes at least one ratcheting system, and would add significantly to the cost of such a hand brake mechanism. Furthermore, such a ratcheting system would also include frictional forces therein, and would not necessarily eliminate the hazards of an outwardly extending handle or lever arm, without still requiring concerted effort by railroad personnel to assure its proper functioning and return to the starting position.

SUMMARY OF THE INVENTION

This invention is predicated on the conception and development of a new, unique and exceptionally low-cost hand brake release handle or lever arm for a hand brake mechanism attached to a wall of a railway car which eliminates the above-said nuisance and hazard by providing an exceptionally simple, two piece hand brake release handle, the outer end of which cannot come to rest at a location where it can be a nuisance or a hazard. The simple and unique hand brake release handle of this invention does not normally require any modification of any existing hand brake mechanism to which it may be attached, and can, accordingly, replace any existing prior art hand brake release handle, to be attachable to, and incorporated with, any presently existing hand brake mechanism to thereby eliminate the above-said nuisance and hazards by merely substituting this exceptionally low-cost handle for practically any prior art handle.

In essence, the inventive hand brake release handle of this invention simply comprises a two piece handle, specifically, a relatively long length lever arm portion, the length of which should be comparable to the length of prior art brake release handles, and a relatively shorter lever arm portion such that the length of this shorter lever arm portion will not present a nuisance or hazard as described above. Both the long and short lever arm portions are attachable to the brake release post, with only the shorter lever arm portion capable of turning the brake release post. The longer lever arm portion, however, is only rotatably attached to the brake release post so that it can be rotated on the brake release post without causing rotation of the brake release post itself. As so attached, the longer lever arm portion is free to rotate on the brake release post adjacent to the fixed shorter lever arm portion. As a final element of the inventive structure, the shorter lever arm is provided with an arm engaging means, such as a bracket or flange, adapted to engage a side edge of the longer lever arm portion when the two lever arms are brought together. Specifically, the engaging means should be such that manual rotation of the longer lever arm portion in a given rotational direction will cause that longer lever arm portion to eventually engage the above-said engaging means, such that continued rotational movement of the longer lever arm portion in the same given rotational direction will cause rotational movement of the shorter lever arm portion and, accordingly, rotational movement of the brake release post to which it is fixedly attached. Such rotational movement of the brake release post, will of course effect the desired hand brake release. After the brake release is effected, the longer lever arm portion may be released manually, and the force of gravity will cause that longer lever arm portion to swing about on the brake release post so that it is merely hanging therefrom with the elongated portion hanging downwardly in an out-of-the-way position, which is not in a nuisance or a hazardous position.

In summary, and in its broadest sense, the inventive hand brake release handle of this invention merely comprises a relatively short-length handle or lever arm for activating the brake release post which is short enough that it cannot be left in a position where it can be a nuisance of hazard. The inventive hand brake release handle further includes a relatively longer-length lever arm suspended from the brake release post which can be rotated into contact with the shorter lever arm to provide any additional torque force as may be necessary to achieve the desired brake release, and which will hang from the brake release post in an out-of-the-way position when not in use.

OBJECTS OF THE INVENTION

It is, therefore, one of the primary objects of the present invention to provide a new and improved hand brake release handle for a hand brake mechanism on a railway car in which an elongated handle or portion thereof cannot be left in a position where it becomes a nuisance or a hazard to persons adjacent to the railway car.

Another primary object of the present invention is to provide a new and improved, yet simple and low-cost, hand brake release handle for a hand brake mechanism on a railway car in which an elongated handle or portion thereof cannot extend outwardly from the hand brake mechanism to become a nuisance or a hazard to persons adjacent to the railway car.

A further primary object of this invention is to provide a new and improved hand brake release handle for a hand brake mechanism on a railway car which in its at-rest position will not extend outwardly from the hand brake mechanism to become a nuisance to railway personnel or a hazard to persons adjacent to the railway car, and which can readily and easily be retro-fitted onto any existing hand brake mechanism.

Still another object of this invention is to provide a hand brake mechanism having a new and improved, yet simple and low-cost, hand brake release handle which in its at-rest position will not extend outwardly from the hand brake mechanism to become a nuisance to railway personnel or a hazard to persons adjacent to the railway car.

In addition to the various objects and advantages of the invention described above, a number of additional objects and advantages of the hand brake release handle of the present invention will become more readily apparent to those persons skilled in the railway braking art from the following more detailed description of the invention, particularly, when such description is taken in conjunction with the attached drawings and the appended claims.

DESCRIPTION OF THE PREFERRED EMBODIMENT OF THE INVENTION

Figure 1:
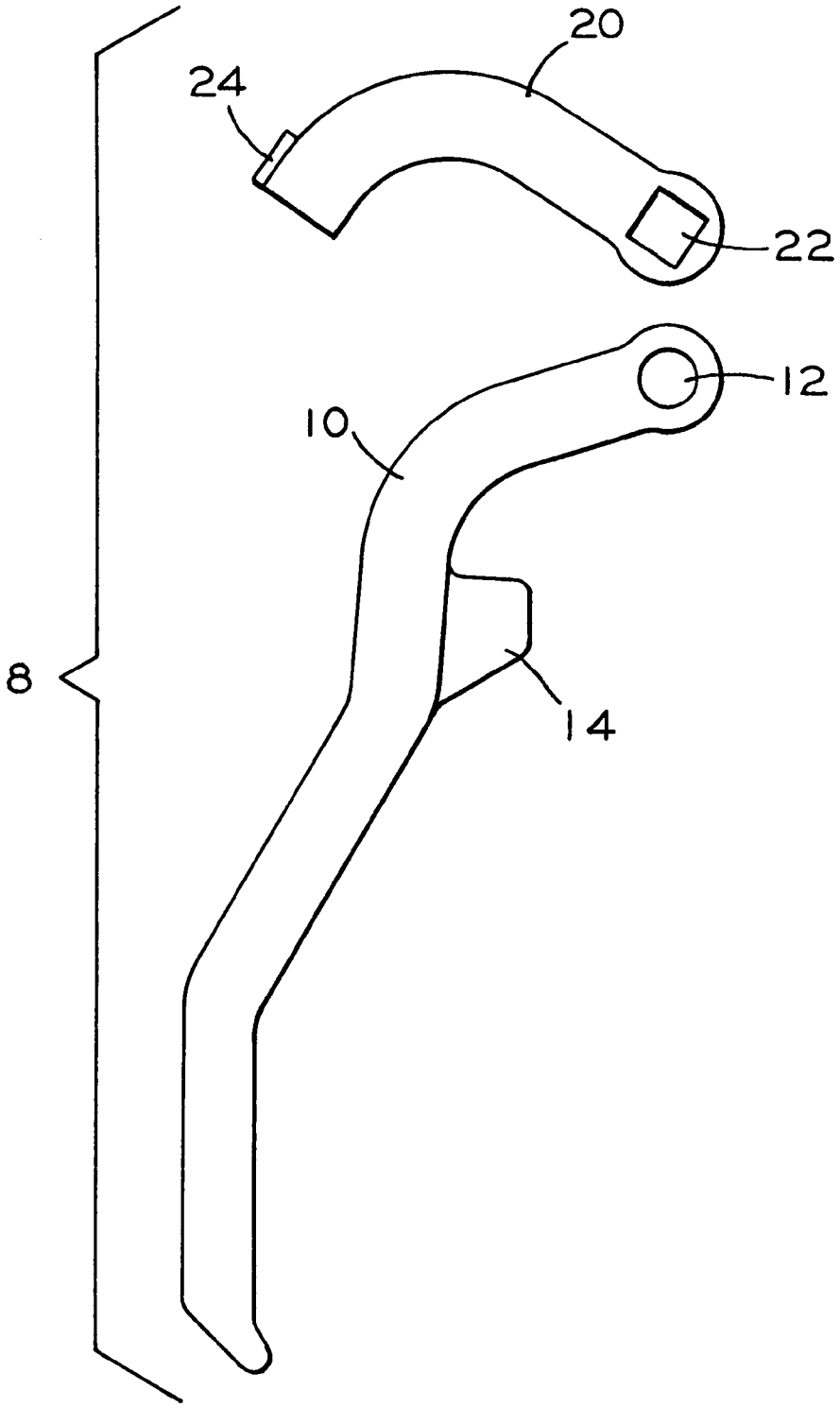
FIG. 1 is a plan view of a presently preferred embodiment of the unique and inventive hand brake release handle of this invention, with the two lever arms thereof shown independently and not joined together.

Prior to proceeding with the more detailed description of the present invention, it should be noted that for the sake of clarity, identical components which have identical functions have been identified with identical reference numerals throughout the several views illustrated in the attached drawing figures.

Now reference is made, more particularly, to FIG. 1 and 3–6 which illustrate a presently preferred embodiment of the inventive hand brake release handle. As shown, the inventive hand brake release handle, generally designated 8, primarily comprises two lever arm portions, namely, a first lever arm 10 having a first aperture 12 at a first end adapted to be loosely fitted onto a rotatable brake release post 32 extending forwardly from a hand brake mechanism 30 (FIGS. 3 and 5), such that manual rotation of first lever arm 10 will not cause rotation of the brake release post 32; and in addition thereto, further comprises a relatively shorter second lever arm 20 having a second aperture 22 at a first end adapted to be tightly fitted onto the rotatable brake release post 32, such that rotation of second lever arm 20 will cause rotation of the brake release post 32. While first aperture 12 on first lever arm 10 is shown to be circular, aperture 12 can have any desired configuration as long as it is capable of rotation independently of brake release post 32, to assure that lever arm 10 can be manually rotated on or near brake release post 32 without any rotational restriction by brake release post 32. Second aperture 22, on the other hand, is shown to be square as may be necessary to be fixedly attached onto a square end of brake release post 32. While other aperture configurations can be used, it is essential the configuration of aperture 22 be such that it can be rigidly secured onto a mating end configuration of brake release post 32 rigidly securing them together, so that rotational movement of second lever arm 20 will achieve a comparable rotational movement of brake release post 32, as is necessary to effect a quick release of the railway car's hand brake system. Accordingly, the relationship of second lever arm 20 to the brake release post 32, is substantially the same as the prior art relationship between the prior art brake release handle and the brake release post 32, so that pivotal movement of second lever arm 20 will effect the desired hand brake release.

A second end of second lever arm 20 is provided with an essential arm engaging means 24 having a surface extending transversely to the longitudinal axis of second lever arm 20 which is adapted to receive and engage an edge surface of the first lever arm 10 when first lever arm 10 is rotated clockwise therepast. It will become apparent that arm engaging means 24 can be provided in practically any form such as a laterally extending flange or a U-shaped bracket, as shown, or any other configuration that will achieve the desired result of preventing first lever arm 10 from rotating clockwise therepast to the extent that any further clockwise rotation of first lever arm 10 will cause a corresponding rotation movement of second lever arm 20 therewith. Hence, manual rotational movement of longer first lever arm 10 in a clockwise direction application of a force to a second end of the longer first lever arm 10 will cause which will eventually cause a corresponding clockwise rotational movement of shorter second lever arm 20, as necessary to effect a hand brake release. Because of the greater length of longer, first lever arm 10 being at least comparable to the length of the prior art hand brake release handle, and as shown, being at least three times greater than the length of the shorter second lever arm 20, one should be able to achieve whatever torque or leverage is required to effect a complete hand brake release.

Although not essential, first lever arm 10 is also provided with spacer 14 extending from a side edge thereof which is adapted to abut against a side edge surface of hand brake mechanism 30 for the purpose of spacing first lever arm 10 away from hand brake mechanism 30 when not being manipulated, making first lever arm 10 easier to grasp. Otherwise, first lever arm 10 would likely extend straight downwardly as a result of gravitational forces so that one would have to reach in behind the handwheel (not shown) attached to a wheel shaft at 34, in order to grasp first lever arm 10 in preparation of a brake release.

It will also be noted that first lever arm 10 is somewhat "S" shaped in form. This specific form or configuration, although not critical, is a form specifically designed to be utilized with the hand brake mechanism 30 as illustrated in FIGS. 2–6, so that the outer end of first lever arm 10 will extend downwardly adjacent to the hand wheel (not shown) where it can readily be grasped when a brake release must be made. As further shown in FIG. 2, the same "S" configuration was utilized in the prior art hand brake release handle 9. Also note that the second lever arm 20 includes a downwardly extending portion.

In addition to the above described elements, other normal elements should also be provided for easy operation of the hand brake release handle 8, which comprises first and second lever arms 10 and 20, such as for example, the inclusion of a washer 30 in some form or another placed on hand brake release post 32 to space apart the two lever arms 10 and 20. As an alternative, or in addition thereto, the sides of the lever arms 10 and 20 can be provided with shallow raised portions encircling the two apertures 12 and 22 which will also serve to space apart the two lever arms 10 and 20. While such feature may be essential for optimum operation of the inventive hand brake release handle 8, the need for such element would be obvious and inherent, and since such matters and techniques are very well known in the mechanical art, they need not be further discussed here.

Figure 3:
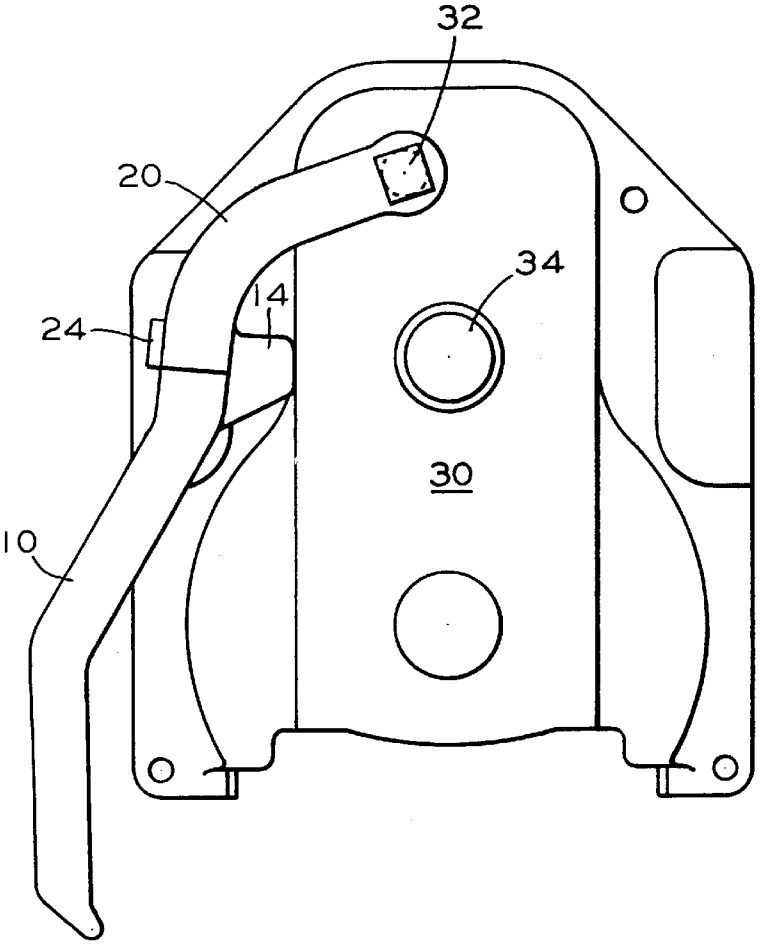
FIG. 3 is a front view of a currently existing hand brake mechanism substantially identical to that shown in FIG. 2, but having attached thereto a hand brake release handle of FIG. 1 as joined together to form the inventive handle.
Figure 5:
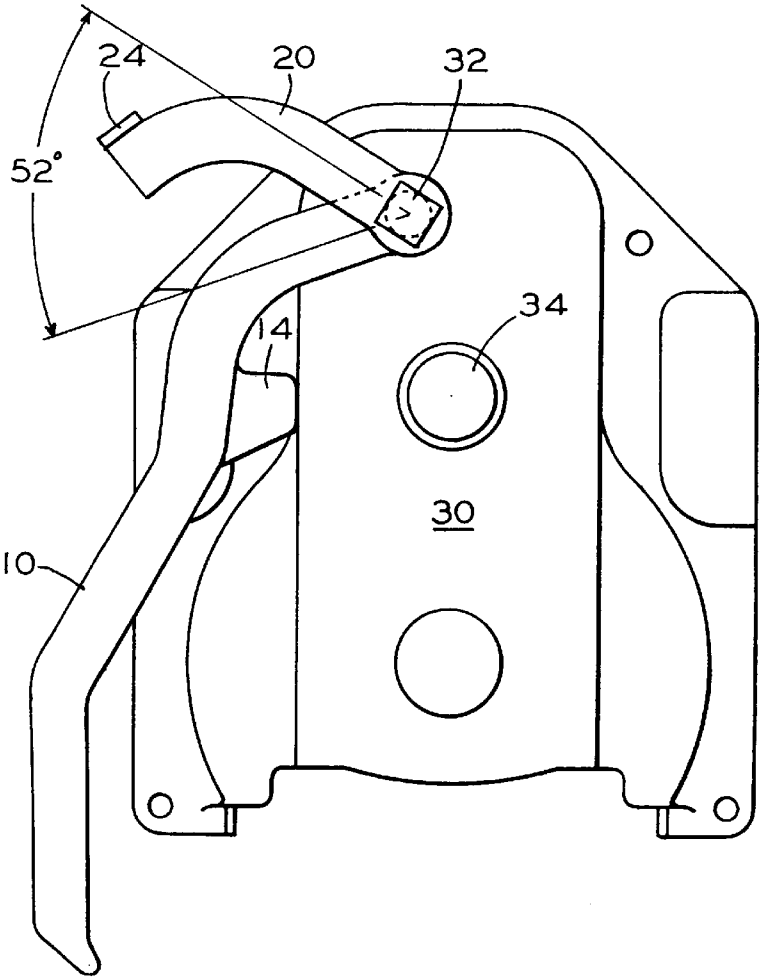
FIG. 5 is substantially the same as FIG. 3 except that the shorter lever arm, as shown, has been rotated to the hand brake release position and so left after the longer lever arm has been released from manual manipulation.

As shown in FIGS. 3 and 5, both the first and second lever arms 10 and 20 are attachable to the brake release post 32 which normally extends through the front plate of hand brake mechanism 30. As shown in the drawings, first lever arm 10 is the first to be attached such that first aperture 12 is placed to fit over the periphery of hand brake release post 32, while second lever arm 20 is fitted onto hand brake release post 32 so that the two must be jointly rotatable about the axis of the hand brake release post 32. As shown in the drawings aperture 22 is provided as a square aperture adapted to fit onto a square end of hand brake release post 32. Obviously, other configurations could be utilized, as well as other techniques, for fixing lever arm 20 onto hand brake release post 32.

Figure 2:
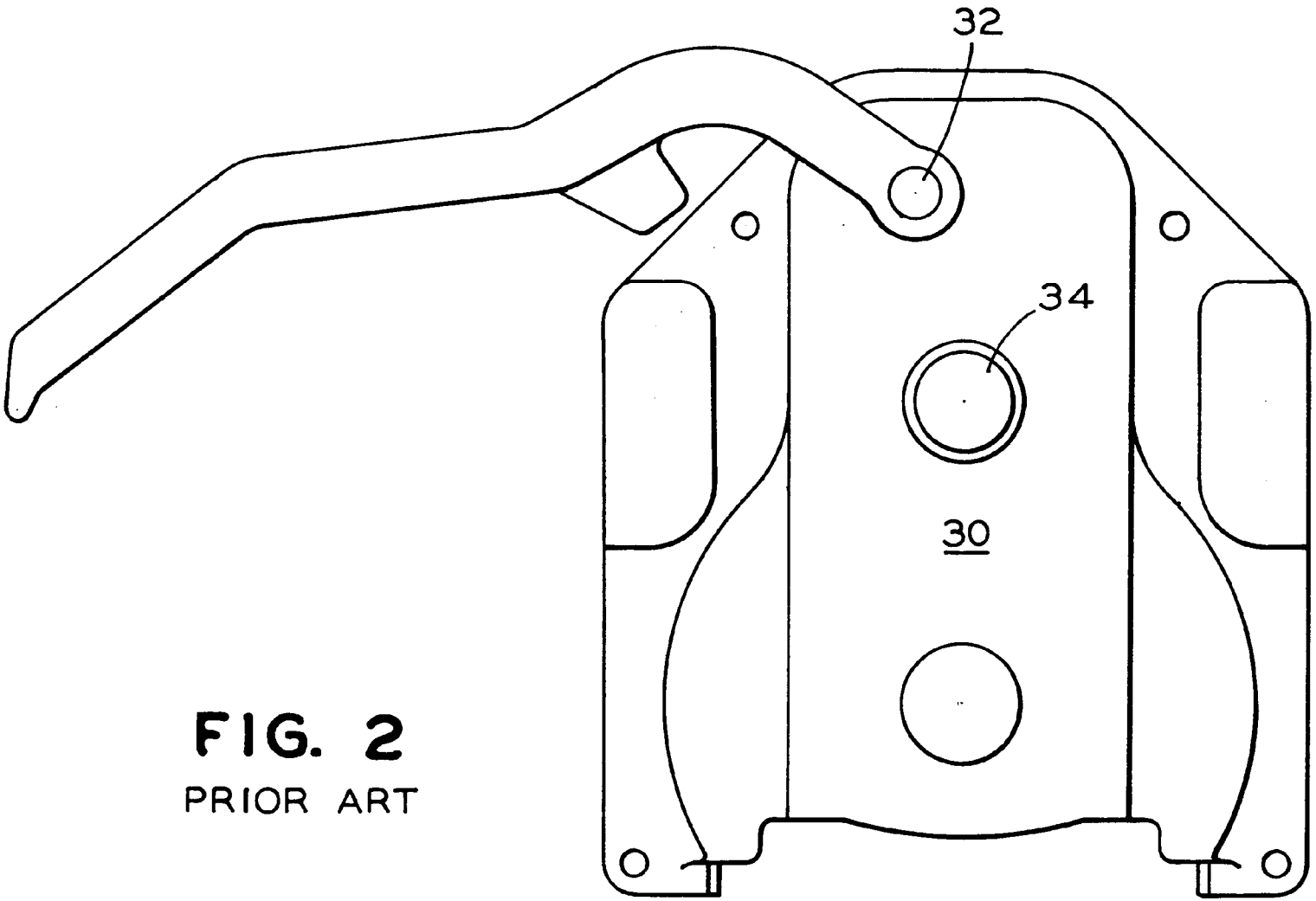
FIG. 2 PRIOR ART
FIG. 2 is a front view of a currently existing hand brake mechanism having a conventional prior art hand brake release handle as it may be disposed in a nuisance or hazardous position as described above, and is accordingly labeled "Prior Art"
Figure 4:
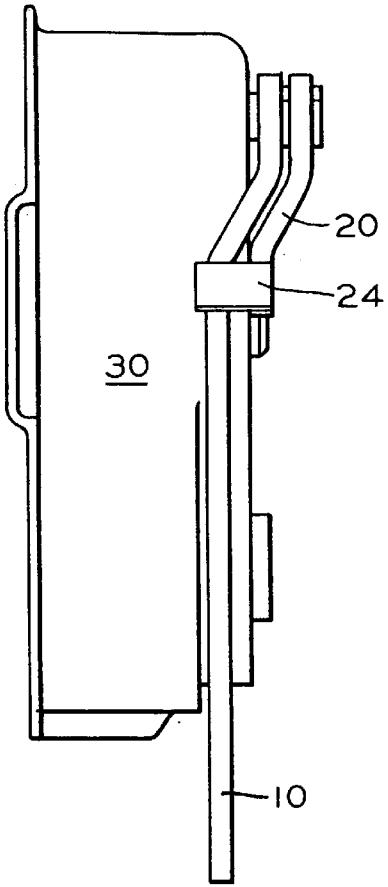
FIG. 4 is an elevational side view of the hand brake mechanism and inventive release handle as shown in FIG. 3.
Figure 6:
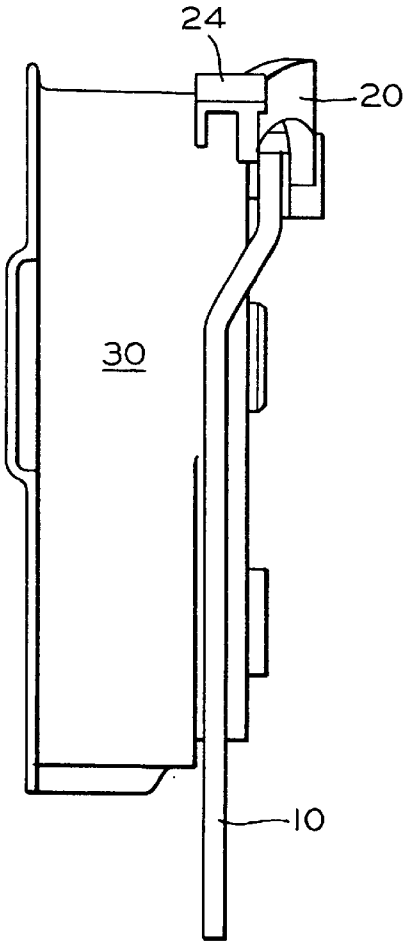
FIG. 6 is an elevational side view of the hand brake mechanism and release handle as shown in FIG. 5.

To operate the railway car hand brake, one must first apply the hand brake by turning the hand wheel (not shown) which is fixedly attached to a shaft at 34. This will serve to wind the brake chain (not shown) onto the brake drum (not shown) and set the hand brake as described above. When it becomes necessary to release the hand brake, one must merely grasp the lower end of first lever arm 10, which would be extending below the lower lefthand side of the hand wheel (not shown), and then pivot first lever arm 10 upwardly in a clockwise direction. This will cause first lever arm 10 to rotate on the outer surface of brake release post 32 until it moves upwardly, clockwise sufficient to come into contact with arm engaging means 24 (e.g. the U-shaped bracket as shown) secured to the second end of second lever arm 20. At that point, continued clockwise rotation of first lever arm 10 will also force second lever arm 20 to rotate upwardly therewith and, accordingly, rotate brake release post 32, as necessary to release the hand brake in the usual sense. When the hand brake is released, the brakeman will, of course, normally release his grip on first lever arm 10 which will then, due to gravitional force, return to its starting position as depicted in FIG. 2. Whether or not second lever arm 20 also returns to the start position as depicted in FIGS. 3 and 4, or remains in the brake release position, as depicted in FIGS. 5 and 6, will not now be of significant concern in view of the fact that its relatively short length will not place it in a nuisance or hazardous position. Accordingly, the advantage of this invention can be seen by contrasting FIGS. 2 and 5, wherein FIG. 2 is representative of a prior art situation wherein the prior art hand brake release handle has been left in its nuisance and hazardous position after one has activated it to release the hand brake, while FIG. 5 is representative of how the inventive hand brake release handle 8 would appear in a similar situation if in fact the second lever arm 20 did not return to the start position after one had activated it to effect a brake release.

As should be apparent, the above disclosed hand brake release handle in essence provides a conventional hand brake release handle (i.e., second lever arm 20) which has a first length which is relatively short and of insufficient length to ever be in a position where it can be a nuisance or a hazard. With such a short length, however, one would not normally be able to get the leverage or torque as necessary to effect a brake release. Accordingly, the longer first lever arm 10 which has a second length greater than the first length of the second lever arm functions as a torque arm capable of being aligned with such a short hand brake release handle and cooperating therewith to provide added length as necessary to have the leverage and torque required to effect a brake release.

Having described in detail, a presently preferred embodiment of this invention, it should be apparent that other embodiments could be utilized and modifications incorporated without departing from the spirit of the invention. As a first example, it has already been noted that a number of differing configurations could be utilized for apertures 12 and 22, as long as aperture 12 will permit rotation of first lever arm 10 on the outer surface of brake release post 32 or at least rotation on the axis thereof, and aperture 22 is designed to rigidly engage brake release post 32 so that rotation thereof will likewise rotate brake release post 32, and while the longer first lever arm 10 is shown to be disposed inside of the shorter second lever arm 20, clearly such arrangement is not critical as long as the above rotational relationships are observed. As also noted above, the use of any known combination of washer, spacers, etc. between the two lever arms 10 and 20 would not depart from the spirit of the invention. Obviously, therefore, numerous other modifications and differing embodiment could be utilized without departing from the spirit of the invention.

I claim:

1. A two piece hand brake release handle for a railway car hand brake mechanism, said two piece hand brake release handle comprising:

(a) a first lever arm having a first end and a second end, said first end of said lever arm being rotatably attachable to such hand brake mechanism and adapted for rotational movement on an axis of a rotatable hand brake release post extending from such hand brake mechanism and such that rotation of said first lever arm will not cause rotation of such hand brake release post, (b) a second lever arm shorter in length than said first lever arm, said second lever arm having a first end and a second end, said first end of said second lever arm being attachable to such rotatable hand brake release post such that rotation of said second lever arm will cause rotation of such rotatable hand brake release post as necessary to effect a hand brake release within such hand brake mechanism, and (c) an arm engaging abutment extending transversely from one of said first and second lever arms adapted to engage an opposite one of said first and second lever arms at said second end of said second lever arm such that application of a force to said second end of said first lever arm will cause upward manual rotation of said first lever arm in a given rotational direction consequently causing said first and second lever arms to become engaged at said arm engaging abutment such that continued upward rotational movement of said first lever arm in said given rotational direction will cause upward rotational movement of said second lever arm and accordingly, rotational movement of such hand brake release post as necessary to effect a hand brake release within such hand brake mechanism.

2. A two piece hand brake release handle for a railway car hand brake mechanism, according to claim 1, in which said second lever arm is of sufficiently short length that it cannot extend outwardly a sufficient amount such as to be a nuisance or hazard when in an upward extended position.

3. A two piece hand brake release handle for a railway car hand brake mechanism, according to claim 1, in which said first lever arm has a length of approximately three-times the length of said second lever arm.

4. A two piece hand brake release handle for a railway car hand brake mechanism, according to claim 1, in which said engaging abutment is disposed at an outer end of said second lever arm spaced from such hand brake release post.

5. A two piece hand brake release handle for a railway car hand brake mechanism, according to claim 1, in which said engaging abutment comprises a U-shaped bracket adapted to receive an edged portion of said first lever arm.

6. A two piece hand brake release handle for a railway car hand brake mechanism, according to claim 1, in which said first lever arm includes a spacer extending therefrom adapted to abut against a side surface of such hand brake mechanism to place said first lever arm in an easy to reach position.

7. A two piece hand brake release handle for a railway car hand brake mechanism, according to claim 1, in which said first lever arm is provided with an aperture adapted to be placed over such rotatable hand brake release post.

8. A two piece hand brake release handle for a railway car hand brake mechanism, according to claim 1, in which said second lever arm is provided with an aperture adapted to be tightly fitted onto such rotatable hand brake release post.

9. A two piece hand brake release handle for a railway car hand brake mechanism, according to claim 1, wherein said first lever arm is capable of automatically returning to a starting position upon a manual release thereof causing said first lever arm to hang downwardly in an out-of-the-way position.

10. A two piece hand brake release handle for a railway car hand brake mechanism, according to claim 1, wherein said first and second lever arms become engaged at a location wherein said arm engaging abutment is positioned between said first and second ends of said first lever arm.

11. A two piece hand brake release handle for a railway car hand brake mechanism, according to claim 1, wherein said second end of said first lever arm and said second end of said second lever arm extend in a downwardly direction.

12. A two piece hand brake release handle for a railway car hand brake mechanism, said two piece hand brake release handle comprising:

(a) a first lever arm having a first aperture at a first end, said first aperture adapted to be loosely fitted onto a rotatable hand brake release post extending from such hand brake mechanism and such that rotation of said first lever arm will not cause rotation of such hand brake release post, (b) a second lever arm shorter in length than said first lever arm having a second aperture at a first end, said second aperture adapted to be tightly fitted onto such rotatable hand brake release post such that rotation of said second lever arm will cause rotation of such rotatable handbrake release post as necessary to effect a hand brake release within such hand brake mechanism, and (c) an arm engaging abutment extending transversely from a second end of said second lever arm adapted to engage said first lever arm such that application of a force to a second end of said first lever arm will cause upward manual rotation of said first lever arm in a given rotational direction consequently causing said first lever arm to engage said arm engaging abutment, such that continued rotational movement of said first lever arm in said given rotational direction will cause upward rotational movement of said second lever arm and accordingly, rotational movement of said such hand brake release post as necessary to effect a hand brake release within such hand brake mechanism.

13. A two piece hand brake release handle for a railway car hand brake mechanism, according to claim 12, in which said second lever arm is of sufficiently short length that it cannot extend outwardly a sufficient amount such as to be a nuisance or hazard when in an upward extended position.

14. A two piece hand brake release handle for a railway car hand brake mechanism, according to claim 9, in which said first lever arm has a length of approximately three-times the length of said second lever arm.

15. A two piece hand brake release handle for a railway car hand brake mechanism, according to claim 12, in which said engaging abutment is disposed at a second end of said second lever arm.

16. A two piece hand brake release handle for a railway car hand brake mechanism, according to claim 12, in which said engaging abutment comprises a U-shaped bracket adapted to receive an edged portion of said first lever arm.

17. A two piece hand brake release handle for a railway car hand brake mechanism, according to claim 12, in which said first lever arm includes a spacer extending therefrom adapted to abut against a side surface of such hand brake mechanism to place said first lever arm in an easy to reach position.

18. A two piece hand brake release handle for a railway car hand brake mechanism, according to claim 12, wherein said first lever arm is capable of automatically returning to a starting position upon a manual release thereof causing said first lever arm to hang downwardly in an out-of-the-way position.

19. A two piece hand brake release handle for a railway car hand brake mechanism, according to claim 12, wherein said first and second lever arms become engaged at a location wherein said arm engaging abutment is positioned between said first and second ends of said first lever arm.

20. A two piece hand brake release handle for a railway car hand brake mechanism, according to claim 12, wherein said second end of said first lever arm and said second end of said second lever arm extend in a downwardly direction.

21. A hand brake release handle for a railway car hand brake mechanism, said hand brake release handle comprising:

(a) a short lever arm having a first length which is insufficient so as to be a nuisance or hazard when in an extended position, said short lever arm having a first end tightly fitted onto a brake release post extending from such hand brake mechanism such that rotation of said relatively short lever arm will cause rotation of such hand brake release post to effect a hand brake release, (b) a long lever arm having a second length greater than said first length of said short lever arm said long lever arm having a first end pivotally connected to such brake release post and pivotal on an axis thereof; and, (c) an arm engaging abutment extending transversely from a second end of said short lever arm adapted to receive and engage said long lever arm such that application of a force to a second end of said long lever arm will cause upward manual rotation of said long lever arm causing said long lever arm to become aligned with said short lever arm and engage said arm engaging abutment and consequently upwardly rotating said short lever arm therewith and accordingly rotating such hand brake release post to an extent necessary to effect a hand brake release.

22. A hand brake release handle for a railway car hand brake mechanism, according to claim 15, in which said second length is approximately three-times that of said first length.

23. A hand brake release handle for a railway car hand brake mechanism, according to claim 21, in which said engaging abutment comprises a U-shaped bracket adapted to receive an edge of said relatively long lever arm.

24. A hand brake release handle for a railway car hand brake mechanism, according to claim 21, in which said long lever arm includes a spacer extending therefrom adapted to abut against a side surface of such hand brake mechanism to place said long lever arm in an easy to reach position.

25. A two piece hand brake release handle for a railway car hand brake mechanism, according to claim 21, wherein said long lever arm is capable of automatically returning to a starting position upon a manual release thereof causing said long lever arm to hang downwardly in an out-of-the-way position.

26. A two piece hand brake release handle for a railway car hand brake mechanism, according to claim 21, wherein said short and long lever arms become aligned at a location wherein said arm engaging abutment is positioned between said first and second ends of said long lever arm.

27. A two piece hand brake release handle for a railway car hand brake mechanism, according to claim 21, wherein said second end of said long lever arm and said second end of said short lever arm extend in a downwardly direction.

* * * * *